US005615694A

United States Patent [19]

Battard et al.

[11] Patent Number: 5,615,694

[45] Date of Patent: Apr. 1, 1997

[54] METHOD OF MODIFYING AND AROMATIZING THE PRIMARY OR SECONDARY SMOKE OF SMOKING PRODUCTS

[75] Inventors: Jean-Claude Battard; Daniel Esnault, both of Loiret, France

[73] Assignee: Societe Nationale D'Exploitation Industrielle des Tabacs et Allumettes, France

[21] Appl. No.: 459,535

[22] Filed: Jun. 1, 1995

Related U.S. Application Data

[63] Continuation of Ser. No. 940,436, Sep. 4, 1992, abandoned.

[30] Foreign Application Priority Data

Sep. 5, 1991 [FR] France ..... 91 10991

[51] Int. Cl.$^6$ ..... A24B 3/12

[52] U.S. Cl. ..... 131/365; 131/335

[58] Field of Search ..... 131/365, 335

[56] References Cited

U.S. PATENT DOCUMENTS

| | | | |
|---|---|---|---|
| 2,460,285 | 2/1949 | Hale . | |
| 3,344,796 | 10/1967 | Yamaji et al. . | |
| 4,140,135 | 2/1979 | Godfrey, Jr. | 131/17 |
| 4,466,451 | 8/1984 | Bonnet et al. | 131/335 |
| 4,804,002 | 2/1989 | Herron | 131/365 |
| 5,172,704 | 12/1992 | Chan et al. | 131/276 |
| 5,514,191 | 10/1992 | Owens, Jr. | 131/365 |

OTHER PUBLICATIONS

Leffingwell et al "Tobacco Flavoring For Smoking Products", 1972, R.J. Reynolds Tobacco Company, Winston Salem, NC pp. 63–64.

Chemical Abstract 108:147386; CH 662042, Sep. 15, 1987.

Derwent 87–291819; CH 662042, Sep. 15, 1987.

*Primary Examiner*—Samuel Barts

*Attorney, Agent, or Firm*—Graham & James LLP

[57] ABSTRACT

The object of the invention is a method for modifying or aromatizing the primary or secondary smoke of smoking products such as cigarettes, cigars and similar products, as well as the mixture intended to be smoked, for instance in a pipe or in the form of a cigarette, by applying to the wrapper of these products at least one solution of the aromatizing or modifying substances which are transferred onto the product in vapor phase in the confined atmosphere of the packing of these products. According to the invention, there is used as solvent a product which is non-volatile at ambient temperature and has a vapor tension less than that of the aromatic substance to be deposited.

13 Claims, No Drawings

METHOD OF MODIFYING AND AROMATIZING THE PRIMARY OR SECONDARY SMOKE OF SMOKING PRODUCTS

This is a continuation of the application Ser. No. 07/440,436 filed Sep. 4, 1992 now abandoned.

The present invention relates to a process intended to modify or aromatize the primary or secondary smoke resulting from the combustion of one or more components contained in the composition of smoking products whether or not having a base of tobacco, such as cigarettes, cigars and similar products as well as the mixture of components intended to be smoked, for instance, in a pipe or in the form of a cigarette, by applying to the wrapping of these products a solution of the aromatizing or modifying substances which are transferred to the product in vapor phase within the confined atmosphere of the package of these products.

By wrapping, there is to be understood either the wrapping of the product such as the paper around the tobacco strand of the cigarette or the wrapper leaf or under-wrapper leaf of the cigar, or the support constituting the packing itself for the smoking product, that is to say the label or carton of the package which is in direct contact with the mixture to be smoked, or the aluminum foils generally surrounding the cigarettes.

Processes of this type are already known, but the aromatizing substance in them is always molten menthol or an alcoholic or aqueous solution.

The present invention is directed at applying the process to any desired aromatic or modifying substance which is volatile at room temperature and at thus producing products having different taste characteristics based on the same smoking mixture.

By way of illustration and not of limitation of such substances, mention may be made of spice extracts such as cinnamon, nutmeg or clove; flowers such as acacia, rose or jasmine; fruit extracts such as lime, orange, cherry or apricot and identical or non-identical natural aromatic molecules such as benzaldehyde, menthol, anisole, carvone and anethole.

In order to obtain the desired result, the invention stipulates the use as solvent of a product which is not volatile at room temperature and has a vapor tension less than that of the aromatic substance to be deposited.

In this way, the solution obtained makes it possible to maintain the aromatic substances in dissolved form on the paper until the time of their transfer from the wrapping onto the product to be smoked within the confined atmosphere.

The solvent will preferably have a vapor tension of less than $10^{-1}$ mm Hg at 20° C. or a boiling point of more than 180° C.

Very good results are obtained when using as solvent a hydroxy or polyhydroxy product, either alone or in mixture, for instance:

- propylene glycol
- triethylene glycol
- butylene glycol
- a polyethylene glycol
- a polypropylene glycol.

The solution will preferably be deposited by a photoengraving process. In this case, it has been found that good results are obtained when the viscosity of the solution is more than 20 centipoises.

In a variant embodiment of the process, different aromatic or modifying solutions can be deposited, these solutions being either compatible or not compatible with each other. One can then, in particular, use a helioavure process known as registered transfer which consists of depositing in succession two or more solutions on limited areas, which may or may not be contiguous or may overlap possibly entirely or in part.

The aromatization in accordance with the invention is simple to carry out and economical with respect to raw material, and it can be used for the manufacture of small series of products having different aromatic notes. The transfer of the aroma onto the material of the product to be smoked takes place in gaseous phase. Smoking discloses substantial differences from the same product to which the same aroma has been added by the processes known in the prior art (spraying or immersion, using an alcoholic and/or aqueous emulsion or solution).

By way of illustration and not of limitation, a few examples of the carrying out of the invention are given below.

EXAMPLE 1

300 g of aromatic solution are prepared by dissolving 40 g of menthol and 30 g of vanillin in 230 g of anethole.

The solution obtained has a dynamic viscosity of 5 centipoises. A mixture of 100 g of equal weight of two Lutrol polyethylene glycols are produced by BASF and known as E 400 and E 1500 respectively, is added to this solution.

There are obtained 400 g of a solution having a viscosity of 20 centipoises.

This solution is applied to the muslin of an aluminum foil by heliogravure printing in an amount of 3.5 g/m$^2$. The coated foil is immediately wound in the form of coils ready for use on the packing machine. After storage for three months in an air-tight plastic container, packages were made with this foil and cigarettes produced with an unsauced blond mixture.

After being set aside for two weeks, the packages were opened and the cigarettes turned over to-a taste panel. As a whole, the aroma of the smoke was judged to be marked by an anise note, with a sweet, fresh and mild taste.

EXAMPLE 2

300 g of cinnamon essence were mixed in 100 g of solvents identical to Example 1. The solution obtained was deposited in the same manner on cigarette paper of a base weight of 25 g/m$^2$ in an amount of 2 g/m$^2$. The cigarettes made with this paper and a mixture of blond tobacco without sauce were submitted, a few days after they had been prepared, to a panel of tasters. The aroma of this smoke was judged to be marked by a cinnamon spice note with a mild, sweet taste.

EXAMPLE 3

150 g of coffee oleoresin and 150 g of a coffee aroma of the ARALOO company were mixed. The mixture, which has a viscosity of more than 100 centipoises, was added to 100 g of propylene glycol. A solution of 40 centipoises was obtained which was deposited, in an amount of 3 g/m$^2$, by heliogravure printing on a strip of reconstituted tobacco of a thickness of 120 m intended to make underwrappers of cigar bodies. Although the filling is not initially aromatized, the experts judged the smoke of these products to be marked by a coffee note with a slight aromatic bitterness.

We claim:

1. A method of modifying or aromatizing the primary or secondary smoke of smoking products, by applying to the wrapping of these products aromatizing or modifying substances dissolved in a solvent which is non-volatile at room temperature and has a vapor tension less than that of the aromatizing or modifying substances to be applied so that the substances are transferred to the smoking products in the vapor phase of the confined atmosphere within the wrapping material of these products.

2. A method according to claim 1 in which the solvent has a vapor tension of less than $10^{-1}$ mm Hg.

3. A method according to claim 1 in which the solvent has a boiling point of more than 180° C.

4. A method according to claim 1, in which the solvent is selected from among propylene glycol, triethylene glycol, butylene glycol, polyethylene glycol and polypropylene glycol.

5. A method according to claim 4, in which the solvent is a mixture of said products.

6. A method according to claim 1, in which the solutions are deposited on the wrapper of the product to be smoked by heliogravure.

7. A method according to claim 5 in which the viscosity of the solutions is at least equal to 20 centipoises.

8. The method according to claim 1, wherein said smoking product is a cigarette.

9. The method according to claim 1, wherein said smoking product is a cigar.

10. The method according to claim 1, wherein said smoking product is a mixture intended to be smoked in a pipe.

11. The method according to claim 1, wherein said smoking product is a mixture intended to be smoked in a cigarette.

12. A method of modifying or aromatizing the primary or secondary smoke of smoking products by using aromatizing or modifying substances dissolved in a solvent which is non-volatile at room temperature and has a vapor tension less than that of the aromatizing or modifying substances to be used, wherein said substances are applied to the wrapping material of these products in order to be transferred to the smoking products in the vapor phase of the confined atmosphere within the wrapping material.

13. A method for applying an aromatizing or modifying substance to smoking products comprising the steps of:

a. dissolving the aromatizing or modifying substance in a solvent which is non-volatile at room temperature and which has a vapor tension less than that of the aromatic or modifying substance;

b. applying the solvent with dissolved aromatic or modifying substance to wrapping materials for the smoking products;

c. wrapping the smoking products with the wrapping materials, whereby the smoking products are contained in a confined atmosphere within the wrapping material, whereby the aromatizing or modifying substance is transferred, in a vapor phase to the smoking products.

* * * * *